United States Patent [19]

Long, II

[11] Patent Number: 4,974,524

[45] Date of Patent: Dec. 4, 1990

[54] DRESSING LOCKER FOR HOME USE

[76] Inventor: Richard A. Long, II, 1218 Lynmar La., Mechanicsville, Va. 23111

[21] Appl. No.: 378,698

[22] Filed: Jul. 11, 1989

[51] Int. Cl.[5] ..... A47B 3/00

[52] U.S. Cl. ..... 108/111; 108/107

[58] Field of Search ..... 108/111, 108, 110, 107, 108/144, 137; 211/134, 135, 186, 153, 151, 184, 195, 183

[56] References Cited

U.S. PATENT DOCUMENTS

| | | | |
|---|---|---|---|
| 1,996,518 | 4/1935 | Levene et al. | 108/107 |
| 2,555,178 | 5/1951 | Young | 211/134 X |
| 2,667,401 | 1/1954 | Knuth | 211/135 X |
| 2,897,978 | 8/1959 | Beckner | 108/107 |
| 4,134,628 | 1/1979 | Mann | 108/111 X |
| 4,512,591 | 4/1985 | Plante | 108/111 X |
| 4,660,477 | 4/1987 | Kortering et al. | 108/108 |

*Primary Examiner*—Jose V. Chen

*Attorney, Agent, or Firm*—Staas & Halsey

[57] ABSTRACT

A dressing locker for home use has mesh material covering opposite sides and the back of a skeletal frame. A seat is provided in a lower portion of the skeletal frame, and at least one shelf is provided in the upper portion of the skeletal frame. The shelf and the seat form upper and lower compartments, respectively, for storing sporting goods or other belongings for children.

10 Claims, 1 Drawing Sheet

DRESSING LOCKER FOR HOME USE

BACKGROUND OF THE INVENTION

1. Field of the Invention

The present invention relates generally to furniture and, more specifically, to a dressing locker for home use by children.

2. Description of the Related Art

Children, both male and female, tend to enjoy mimicking the lives of their sports heroes. Children often see their sports heroes being interviewed from the locker room after a game in front of the players' locker. The locker itself is generally a permanent fixture in a locker room, which is usually associated with a sporting complex such as a football stadium or basketball arena.

A problem for children is that locker rooms are generally inaccessible and thus they cannot experience first hand what it is like to have a locker. A somewhat unrelated problem for parents is that it is difficult to motivate children to organize their belongings including clothing and sporting equipment. For most children, keeping a clean room is not high on the adolescent list of priorities, and thus, constant parental supervision is required.

A need exists for an object which can make keeping a room seem like play to children.

SUMMARY OF THE INVENTION

An object of the present invention is to provide a dressing locker which affords children the opportunity to emulate their sporting heroes.

Another object of the present invention is to provide a dressing locker for home use which can be easily assembled.

Yet another object of the present invention is to provide a dressing locker which is capable of organizing a child's belongings such as clothing and sporting equipment.

These and other objects of the present invention are met by providing a dressing locker for home use including an elongated, vertically-oriented skeletal frame having a base for setting on a floor, a top, a front, a back and two opposed sides, a first sheet of mesh material covering the back of the frame, second and third sheets of mesh material covering the two opposed sides of the frame, respectively, and a seat extending between the two opposed sides of the frame.

Preferably, a shelf is provided in the upper portion of the frame, along with hooks or hangers for hanging clothing.

The skeletal frame is preferably made of right-angled metal segments bolted together to form panels.

These and other features and advantages of the invention will become more apparent with reference to the following detailed description and drawings.

DETAILED DESCRIPTION OF THE PREFERRED EMBODIMENT

Figure 3:
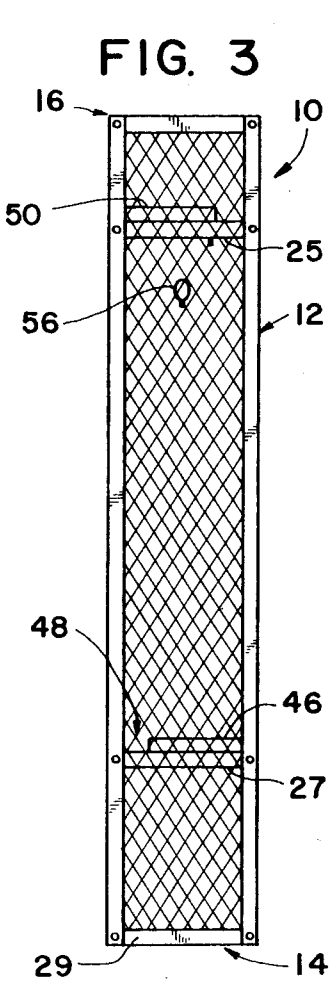
FIG. 3 is a side elevational view of the embodiment of FIG. 1.
Figure 2:
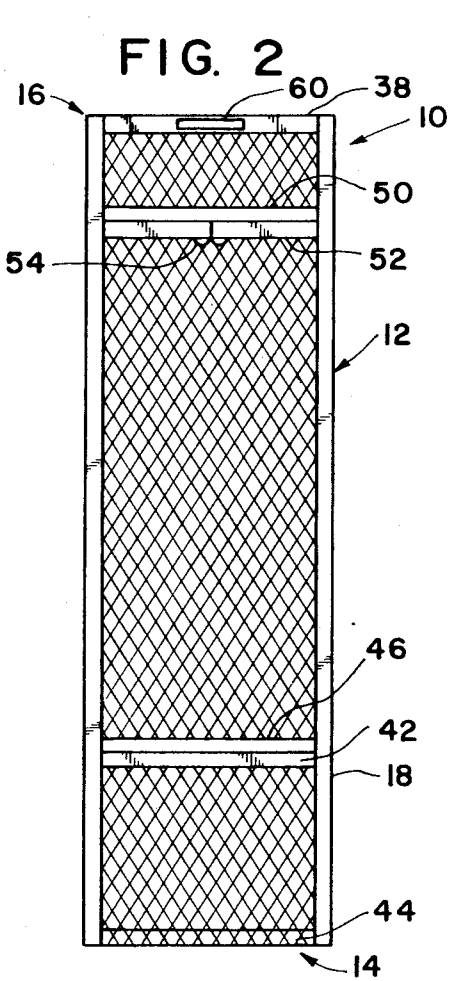
FIG. 2 is a front elevational view of the embodiment of FIG. 1.
Figure 1:
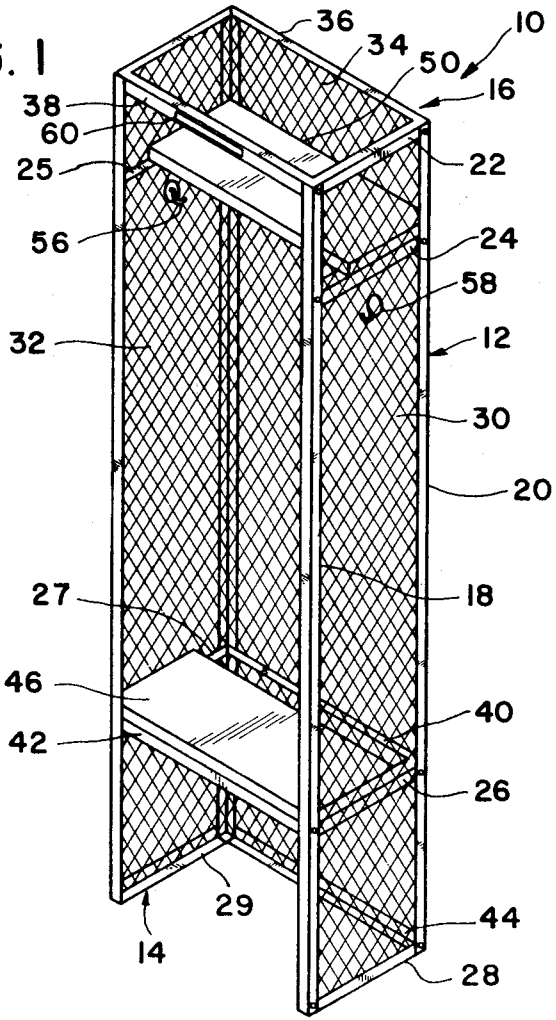
FIG. 1 is a perspective view of a first preferred embodiment of a dressing locker for home use according to the present invention.

Referring to FIGS. 1 through 3, a dressing locker is generally referred to by the numeral 10, and includes an elongated, vertically-oriented skeletal frame 12 having a base 14 for setting on a floor such as in a child's bedroom, a top 16, a front, a back and two opposed sides. The frame 12 is made of bolted-together angled-metal segments which form three panels: two side panels and a back panel. In FIG. 1, the right-side panel is made of two vertical segments 18 and 20 which are spaced apart by horizontal segments 22, 24, 26 and 28. The vertical segments 18, 20 and the horizontal segments 22, 24, 26, 28 are bolted together to form one of two side panels, the opposite side panel having a substantially identical construction. The rear panel has similar vertical and horizontal segments.

Each panel, and thus, each of the two opposed sides and the back, are covered with a sheet of mesh material. A first sheet 30 extends between the opposite ends and opposite sides of the right-hand panel (between vertical segments 18, 20 and horizontal segments 22, 28). A second sheet 32 extends between similar structure in the opposite side panel, and a third sheet 34 covers the back panel. The mesh material may be relatively rigid metal wire which is tack-welded or otherwise suitably connected to respective segments of the frame. As an alternative, the mesh may be clamped onto corresponding frame segments by known clamping means such as those which employ threaded fasteners. A preferred metal mesh is made by a known "slit-and-stretch" method.

The paneled construction is preferred for home assembly. However, since the device is made for children and, therefore, not especially large (such as about 20 inches wide), the skeletal frame need not include a separate back panel, but may instead have the back panel formed by assembling the two opposed sides with horizontal crosspieces 36, 38, 40, 42 and 44.

The horizontal segments 26 and 27, as well as the crosspieces 40 and 42 are right-angled metal pieces which collectively define a horizontal rectangular supporting flange for supporting a seat 46 in a lower portion of the frame 12. The seat 46 has a rectangular shape and has a shorter width than the rectangular supporting flange. The seat 40 is preferably disposed in a forwardmost position so as to leave a rearward space 48 between the rearward edge of the seat 46 and the back panel or crosspiece 40. This space 48 is particularly adapted for receiving sporting equipment such as baseball bats, hockey sticks, etc. The seat 46 also helps form a compartment between the floor and the seat which is particularly suitable for storing other types of sporting equipment o toys.

The base of the frame is similarly formed by horizontal segments 28 and 29 and horizontal crosspiece 44, which collectively define a flat-supporting surface suitable for resting on a floor.

A shelf 50 is supported in an upper portion of the frame 12 on a horizontal supporting flange defined by upper surfaces of horizontal segments 24 and 25 and crosspiece 52. The shelf 50 is disposed in a rearwardmost disposition so as to improve headroom for the user. Both the shelf 50 and the seat 46 need not be attached to their corresponding supporting flanges and thus may slide between forward and rearward positions, if necessary.

The shelf 50 may be provided with a hook 54 on a lower surface thereof for hanging either articles of clothing or sporting equipment. Side hooks 56 and 58 may be attached to the opposite sides of the frame on the mesh sheets just below the horizontal segments 24 and 25. These hooks 56 and 58 provide additional hanging capabilities for clothing or sporting equipment.

In addition to metal mesh which is tack-welded or otherwise suitably attached to corresponding frame segments, the mesh may be a plastic mesh material which is stretched between opposite sides and ends of each panel, and attached by any suitable means including adhesive bonding or thermal bonding. Plastic mesh has the advantage that it is lighter and generally less expensive. However, wire mesh has the advantage that it can contribute to the structural integrity of the overall device.

The device described above enables children to emulate sports heroes by having a dressing locker which they use in their own homes. As an added feature, the crosspiece 38 may be provided with an individualized nameplate 60 which reinforces the theme that the child owner can take pride in his or her personal habitat.

The metal used in the frame segments may be steel, aluminum, or other metal and/or metal alloys so long as they have sufficient strength to support the owner and his or her belongings. The shelf and seat are preferably made of wood, although the choice of wood is mainly based o appearance and comfort.

Numerous modifications and adaptations of the dressing locker for home use of the present invention will be apparent to those of skill in the art and thus it is intended by the following claims to cover all such modifications and adaptations which fall within the true spirit and scope of the invention.

I claim:

1. A dressing locker for home use comprising:

an elongated, vertically-oriented skeletal frame having a base for setting on a floor, a top, a front, a back and two opposed sides;

a first sheet of mesh material covering the back of the frame;

second and third sheets of mesh material covering the two opposed sides of the frame, respectively;

a plurality of horizontal segments included in said skeletal frame;

at least some of said plurality of horizontal segments forming horizontal rectangular supporting flange coupled to said skeletal frame at a lower portion of said skeleton frame; and a seat mounted on said rectangular supporting flange, having a width smaller than the width of said rectangular supporting flange, and being disposed in a forward-most position on said rectangular supporting flange to define an opening between a rearward edge of said seat and said back of said skeletal frame through which items to be stored extend.

2. A dressing locker according to claim 1 wherein said skeletal frame includes a plurality of vertical segments which are spaced apart and held together by a plurality of said horizontal segments.

3. A dressing locker according to claim 2, wherein said vertical segments, and said horizontal segments are made of angled metal.

4. A dressing locker according to claim 1, further comprising at least one shelf disposed in an upper portion of the skeletal frame.

5. A dressing locker according to claim 4, wherein the at least one shelf has upper and lower surfaces, and the lower surface is provided with a hook for hanging articles of clothing.

6. A dressing locker according to claim 5, further comprising second and third hooks provided respectively on opposite sides of the skeletal frame just below the at least one shelf.

7. A dressing locker according to claim 4, wherein the skeletal frame includes at least two horizontal segments which are disposed in an upper portion of the skeletal frame on opposite sides thereof, the horizontal segments having upper surfaces which provide a supporting flange for the shelf.

8. A dressing locker according to claim 7, wherein the at least one shelf is disposed in a rearward-most position on the upper surfaces of the horizontal segments, the at least one shelf forming an upper compartment with the upper surface thereof and the opposite sides and back of the skeletal frame.

9. A dressing locker according to claim 1, wherein the first, second and third sheets of mesh material are each made of metal mesh, each sheet of metal mesh being connected along peripheral edges thereof to corresponding portions of the skeletal frame.

10. A dressing locker according to claim 1, further comprising a name plate connected to the skeletal frame on the top and front thereof.

* * * * *